US007642888B2

(12) United States Patent
Avila Montes et al.

(10) Patent No.: US 7,642,888 B2
(45) Date of Patent: Jan. 5, 2010

(54) ELECTRIC REACTOR OF CONTROLLED REACTIVE POWER AND METHOD TO ADJUST THE REACTIVE POWER

(75) Inventors: Jesús Avila Montes, Nuevo León (MX); Raymundo Carrasco Aguirre, Nuevo León (MX)

(73) Assignee: PROLEC GE, S. de R. L. de C. V., Apodaca, N. L. (MX)

( * ) Notice: Subject to any disclaimer, the term of this patent is extended or adjusted under 35 U.S.C. 154(b) by 264 days.

(21) Appl. No.: 11/673,437

(22) Filed: Feb. 9, 2007

(65) Prior Publication Data

US 2008/0068119 A1 Mar. 20, 2008

(51) Int. Cl.
*H01F 21/08* (2006.01)

(52) U.S. Cl. ..... 336/155; 307/83

(58) Field of Classification Search ..... 336/145, 336/170, 178, 180–184, 214, 215
See application file for complete search history.

(56) References Cited

U.S. PATENT DOCUMENTS

| | | | | |
|---|---|---|---|---|
| 3,147,455 | A * | 9/1964 | Owen | 336/133 |
| 3,221,280 | A * | 11/1965 | Malsbary et al. | 336/5 |
| 3,242,419 | A * | 3/1966 | Walburn | 323/334 |
| 3,372,283 | A * | 3/1968 | Jaecklin | 307/83 |
| 4,540,931 | A | 9/1985 | Hahan | |
| 4,837,497 | A | 6/1989 | Leibovich | |
| 5,666,275 | A * | 9/1997 | Inokuchi et al. | 363/35 |
| 5,737,203 | A * | 4/1998 | Barrett | 363/75 |
| 2004/0012472 | A1 * | 1/2004 | Sasse et al. | 336/180 |

FOREIGN PATENT DOCUMENTS

| | | |
|---|---|---|
| ES | 340896 | 6/1968 |
| ES | 2001118 | 3/1991 |
| JP | 11144963 | 5/1999 |
| RU | 2231153 | 6/2004 |

* cited by examiner

*Primary Examiner*—Elvin G Enad
*Assistant Examiner*—Tszfung Chan
(74) *Attorney, Agent, or Firm*—Egbert Law Offices PLLC

(57) ABSTRACT

An electric reactor of controlled reactive power is formed by a magnetic core, and at least one primary winding to which a main current is supplied to generate a main magnetic flow on the magnetic core. The reactor also includes at least a generator of the magnetic distortion field to which a control current is supplied to generate a field of magnetic distortion on the magnetic core. The magnetic distortion field is opposed to the main magnetic flow generating a distortion of the latter, achieving a change in the magnetic core reluctance and in this way a change in the reactive power of consumption of the reactor. In addition, a method is described to adjust the reactive power in an electric reactor.

5 Claims, 5 Drawing Sheets

ELECTRIC REACTOR OF CONTROLLED REACTIVE POWER AND METHOD TO ADJUST THE REACTIVE POWER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

This invention relates to electric reactors. More specifically, this invention relates to a controlled reactive power reactor through the use of magnetic distortion fields.

2. Description of Related Art Including Information Disclosed Under 37 CFR 1.97 and 37 CFR 1.98

At present the electric reactors are the most compact means and the most cost-efficient relation to compensate for the capacitive generation on high-tension lines for long-distance transmission, or long-distance cable systems. Electric reactors are generally used in a permanent service to stabilize the power transmission, or connected only under low-load conditions for voltage control. Although the design aspect of an electric reactor is similar to the one of a power transformer, the input currents, linearity, the generation of harmonics and symmetry between phases are very different.

At present, the most commonly used electric reactor is of the shunt type, also known as "reactor shunt" or the "air gap core", which can be of the enclosed or column type. The latter is formed by a magnetic core provided by two lateral columns and one central column of air gaps where a main winding is concentrically wound.

The upper ends of the columns are interconnected through an upper yoke whereas the lower ends are interconnected through a lower yoke. The magnetic core is generally formed by stacked sheets that are parallel with the plane where the two lateral columns are located.

The core of the electric reactor of the column type is exactly the central column of air gaps that is generally cylindrical and consists of various ferro-magnetic doughnuts and air-gap spacers embedded between the ferro-magnetic doughnuts. The doughnuts are stacked together in the form of a column. The central column of air gaps must have an elevated elasticity module that reduces the reactor resonance to a minimum, because during the operation of the former, the magnetic field creates intermittent forces through all the air-gap spacers to a point where the forces add up to tens of tons. At present, the elevated elasticity module of the central column of air gaps is obtained while maintaining the union between the ferro-magnetic doughnuts extremely rigid. The air-gap spacers, with the use of epoxy glue and a central pin that passes through the column and maintains the upper and lower yoke together by the use of a bolt-nut mechanism, allows the elimination of the vibrations during the operation of the reactor.

The structure of the electric reactor described above presents the inconvenience that over time, in spite of the mechanism used to maintain the central column of air gaps rigid, generates considerable noise due to the vibration of the air-gap spacers located between the different ferro-magnetic doughnuts that are compressed. The precision, that was adjusted when mounting the frame of the central column at the start connecting it to the yokes of the core, diminishes. The unfavorable phenomenon is presented particularly, if due to inexactness of the thickness and height dimensions of the air-gap spacers and the ferro-magnetic doughnuts, or if because of an elasticity difference or decrease differences of the different air-gap spacers, the upper yoke does not rest equally on all the columns of the core frame. A solution to this disadvantage is described in the Spanish patent ES-340,896.

Added to the former, depending on the required application of the electric reactor, the latter can involve an adjustment or regulation of the relation of reactive power in one or more steps. At present, it is common to do this by means of load tap changers, or through a semi-permanent adjustment of the relation of turns of the main winding by one or more steps when the reactor is disconnected via the load taps. The adjustment or regulation of the relation of reactive power of the reactors in the distribution network is necessary to be able to guarantee a stabilization of the power transmission and the capacitive generation on long-transmission high-tension lines or in long-distance cable systems.

Another current solution to reach an adjustment of the reactive power with precision and speed is the technology known as a "Magnetically Controlled Reactor" (MCR) developed by Alexander M. Bryantsev et al. Its functioning principle is first based on directly controlling the magnetic flow in the reactor core, while some of the winding turns are periodically taken into short-circuit by means of the semiconductor interrupters and/or provoking magnetically the core saturation. The former are described in the Russian patents RU-989,597, RU-2,231,153, RU-2,132,581 and RU-2,141,695.

At present, electronic switches are also used in the form of transistors or thiristors. Such a solution is described by Paulus G. J. M. Asselman et al. in the publication of the Mexican patent application MX-9800816, which refers to a method and a device to continually adjust, within a determined adjustment interval, the transformation relation or the amount of turns between the primary winding and the secondary winding of a power transformer provided by at least one regulator winding, where a first outlet is connected during part of a cycle of the alternate voltage of the transformer and a second outlet is connected during other part of the cycle of the alternate voltage.

Also common is the use of interlaced or crossed windings, as described by Andre Kislovski in the Spanish patent ES-2,001,118, where an electrically adjustable construction inductive element is shown, that consists of two ferro-magnetic cores magnetically independent from each other, equal, annularly enclosed that individually carry the partial windings of an induction winding and together they carry the controlling operation coil. The direction of the turning of the partial windings and the induction is such that the generated magnetic fields in one of the cores are mutually weakened by currents through the windings, while being increased in the other core.

Another alternative current solution to provide a variable reactor is to use two or more magnetic cores, linked with common core elements as described by Gregory Leibovich in the U.S. Pat. No. 4,837,497, illustrating a transformer or variable reactor with as a base the combination of at least two cores with a common yoke. The primary winding is divided in two independently fed sets of phase coils wound in opposed directions, arranged on symmetrical legs and columns of the cores and separated by the common yoke. The secondary winding with each phase coil divides into two parts and is wound in opposite directions on the symmetric core legs of the base, adjacent to the parts of the primary coil and separated by the common yoke. The winding of secondary short circuits of the transformer or reactor is reduced to at least one close loop member with loop portions separated by the common yoke. The polyphasic apparatus has at least one primary coil per set that includes a controllable device in circuit relation therewith to enable control of one primary coil relative to the other, either in current magnitude or in current phase shift. The controllable device is a rectifier, TRIAC or transistor. Therefore, having continuous control of the controllable device, an apparatus with variable output parameters is obtained.

Another alternative to provide a reactor of controllable reactive power consists in forming a reactor with a magnetic core whose structure has movable elements, or with displacement that allows forming a variable air space in the core. This brings about a change in the magnetic flow induced by the windings, thus allowing a control of the reactive power in a linear or gradual way. The control of the movement in movable elements for opening and closing of the variable air space of the core, may be performed by mechanisms of manual, semi-automatic or automatic displacement control. An example of this application is described by Steven Hahan in U.S. Pat. No. 4,540,931, which shows a transformer that includes a system for control of electric output voltage that uses a core with movable structure. The electric output voltage of the transformer is perceived and the latter makes itself corresponded to a predetermined standard movement of the movable structure, which is then blocked when positioned in the correct location. The changes in electric voltage are free of steps and the linear control of the electric voltage in relation to the time is reached through the non-linear movement of the movable structure, allowing a wide range of variation in the electric output voltage.

Another present variation to provide an electric reactor of controlled reactive power is described by Kurisawa Hideakin in the Japanese patent JP-11144963, where the electric reactor consists of a conductive cylinder which is externally concentric to the winding and in electric contact with the latter so that the cylinder makes itself displaced in a controlled manner along the winding axis with the help of a displacement mechanism with the aim of obtaining a certain amount of turns of the winding to enter into short circuit, thus allowing to vary the reactive power of the reactor.

The aforementioned solutions represent complex control systems that require load taps switches controlled by mechanical devices, a reconfiguration of the winding turns or of the magnetic core, and/or use of mechanical or servomechanic equipment applicable to the formation of variable air space in the magnetic core, as well as the use of mechanisms that maintain the rigid structure of the core, all the former to provide a reactor of controlled reactive power. Therefore, it is necessary to provide an electric reactor of controlled reactive power which allows adjusting the reactive power under load or not, in a simple and economic way in the distribution networks with major precision, speed and a wide operational range, as well as to maintain the rigid structure during its operation time compared with the state of the art, through the use of magnetic distortion fields in the reactor core.

BRIEF SUMMARY OF THE INVENTION

Referring to the aforementioned and with the purpose of offering a solution to the encountered limitations, this invention is aimed at offering an electric reactor of controlled reactive power that consists of a magnetic core, at least a primary winding receiving a main current to generate a main magnetic flow in the magnetic core. The reactor includes at least a generator of a magnetic distortion field to which a control current is delivered to generate a magnetic distortion field in the magnetic core so that the control current has an intensity that varies in relation to the reactive power consumption required according to the system's necessities of compensation of reactive power to which the reactor is connected. Thus, the magnetic distortion field is combined with the main magnetic flow generating a distortion of the latter, achieving a change in the magnetic reluctance of the core and thus a change in the reactive consumption power of the reactor.

It is also an objective of the present invention to offer a method to adjust the reactive power of an electric reactor wherein the reactor consists of at least a magnetic core, at least a primary winding and at least a magnetic distortion field generator. The method contains the steps to provide a main current to at least one primary winding to generate a main magnetic flow in a magnetic core; to detect the consumption of the required reactive power that varies in relation to the compensation necessities of the system's reactive power to which the reactor is connected, and to generate at least one magnetic distortion field in the magnetic core, detecting the required reactive power consumption. Thus, the magnetic distortion field combines with the main magnetic flow, generating a distortion of the latter, achieving a change in the magnetic reluctance core, and thus a change in the reactive consumption power of said reactor.

BRIEF DESCRIPTION OF THE SEVERAL VIEWS OF THE DRAWINGS

The characteristic details of the present invention are described in the following paragraphs, together with the figures related to it, in order to define the invention, but not limiting the scope of it.

DETAILED DESCRIPTION OF THE INVENTION

Figure 1:
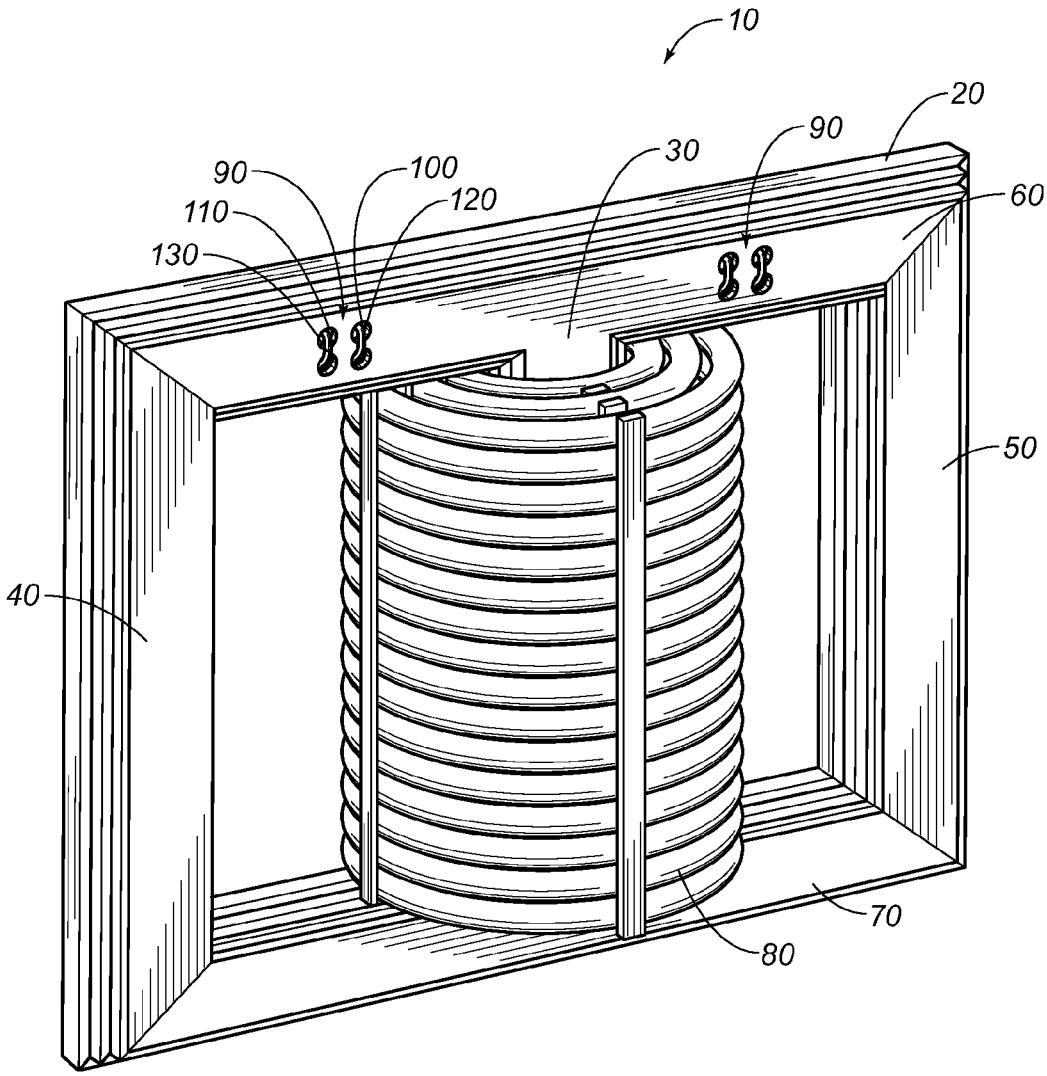
FIG. 1 is a perspective view of an electric reactor of controlled reactive power according to the present invention.

FIG. 1 shows an embodiment of the invention referring to an electric reactor with controlled reactive power 10, which has a magnetic core 20 of a column type consisting of a central column 30 and two external columns 40 and 50, all remaining mentioned columns being essentially in the same plane. The three columns are interconnected at their superior ends via a superior yoke 60 while their inferior ends are interconnected by an inferior yoke 70. The magnetic core 20 consists advantageously of stacked sheets which are parallel with the plane where the three columns are located (30, 40 and 50). The material, amount and thickness of the sheets that form the different columns (30, 40 and 50) and yokes (60 and 70) may obviously be selected according to the normal criteria for the design of magnetic cores.

At least one main winding 80 is concentrically wound around the central column 30. In the electric reactor the controlled reactive power 10, the main winding 80 may be formed by various concentric layers of turns.

The magnetic core 20 consists of at least one generator of magnetic distortion field 90 that may be formed by a first pair of orifices 100 and a second pair of orifices 110 that pass through the thickness of the magnetic core 20, whether through a column or a yoke of the mentioned structure of a window type so that both pairs of orifices are generally adjacent. The term "orifice", as used in the context of the present description means an opening, nozzle or orifice that may have any form and passes through an solid part of the magnetic core 20. In the first pair of orifices 100, a first control coil 120 is found wound up, and a second control coil 130 is wound in the second pair of orifices 110. In the three-phase case, it is necessary that each generator of magnetic distortion field 90 is located in a position relative to the magnetic core 20 so that it allows maintaining the magnetic equilibrium of the latter to assure reactive powers of consumption for each balanced phase.

A main current passes through the main winding 80, inducing a main magnetic flow in the magnetic core 20. In order to control the reactor's reactive power of consumption, the main magnetic flow is controlled when an alternate or continual control current passes simultaneously through each generator of the magnetic distortion field 90 to form fields of magnetic distortion of equal intensity in the magnetic core 20, so that each magnetic distortion field combines with the main magnetic flow originating a distortion in the latter while obtaining a resulting magnetic field.

In each generator of a magnetic distortion field 90, the control current is simultaneously provided to the first control coil 120 and to the second control coil 130 through some means to provide control current (not shown) that are electrically connected to these control coils. This control current is provided when a variation is detected in the required consumption of reactive power that varies in relation to the necessities of reactive power compensation of the system to which said reactor is connected. Thus, the reactive power of consumption makes itself corresponding to a current intensity that feeds each of the generators of magnetic distortion fields 90 to form the magnetic distortion fields in order to obtain the desired controlled reactive power of consumption.

Figure 2:
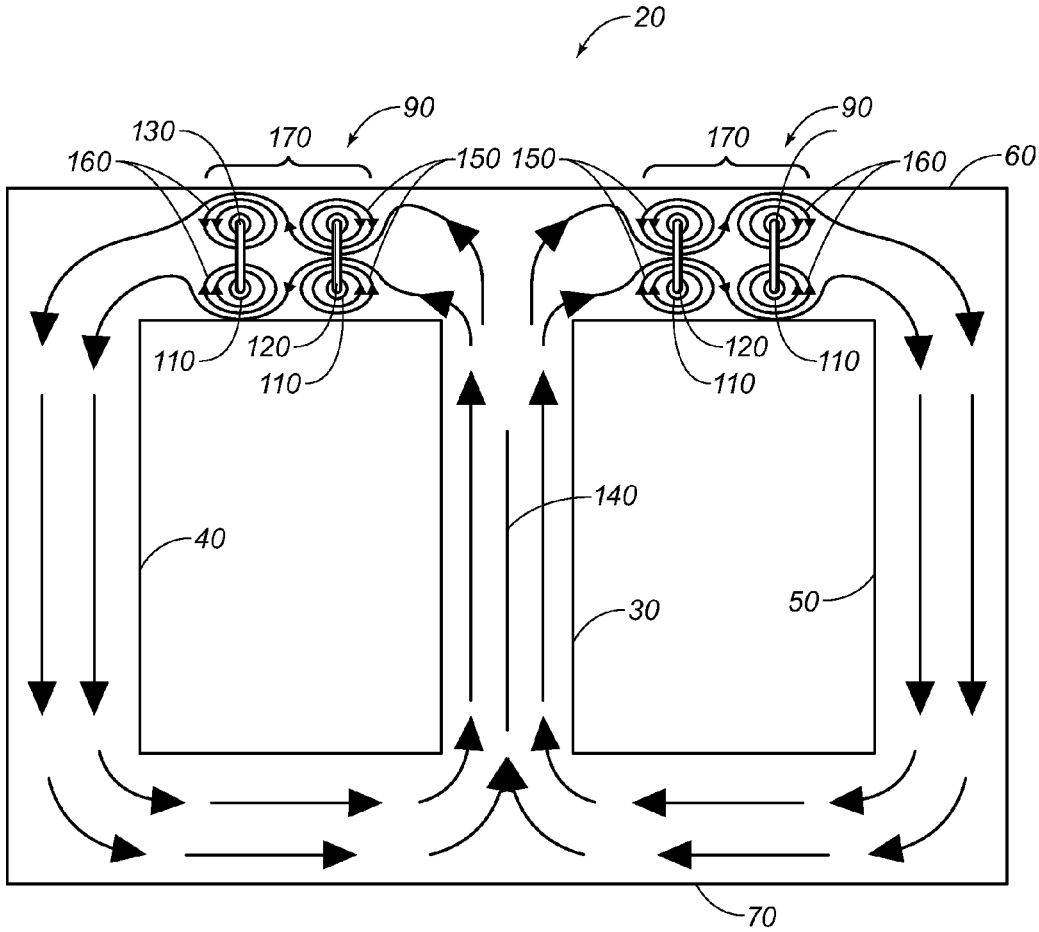
FIG. 2 shows a lateral schematic view of a magnetic core of an electric reactor of controlled reactive power with the presentation of the direction of a main magnetic flow, distorted by magnetic distortion fields according to the present invention.

FIG. 2 shows a lateral view of a magnetic core 20 of the column type, where magnetic core 20 has a central column 30 and two external columns 40 and 50, interconnected through an upper yoke 60 and an inferior yoke 70.

From the perspective of the magnetic core 20, there is at least one generator of magnetic distortion field 90 formed by a first pair of orifices 100 and a second pair of orifices 110 that pass through the thickness of the magnetic core 20, through a column or a yoke, or through a combination of both. In the first pair of orifices 100, a first control coil 120 is wound with one or more spirals, while in the second pair of orifices 110 a second control coil 130 is wound with one or more spirals.

Figure 3:
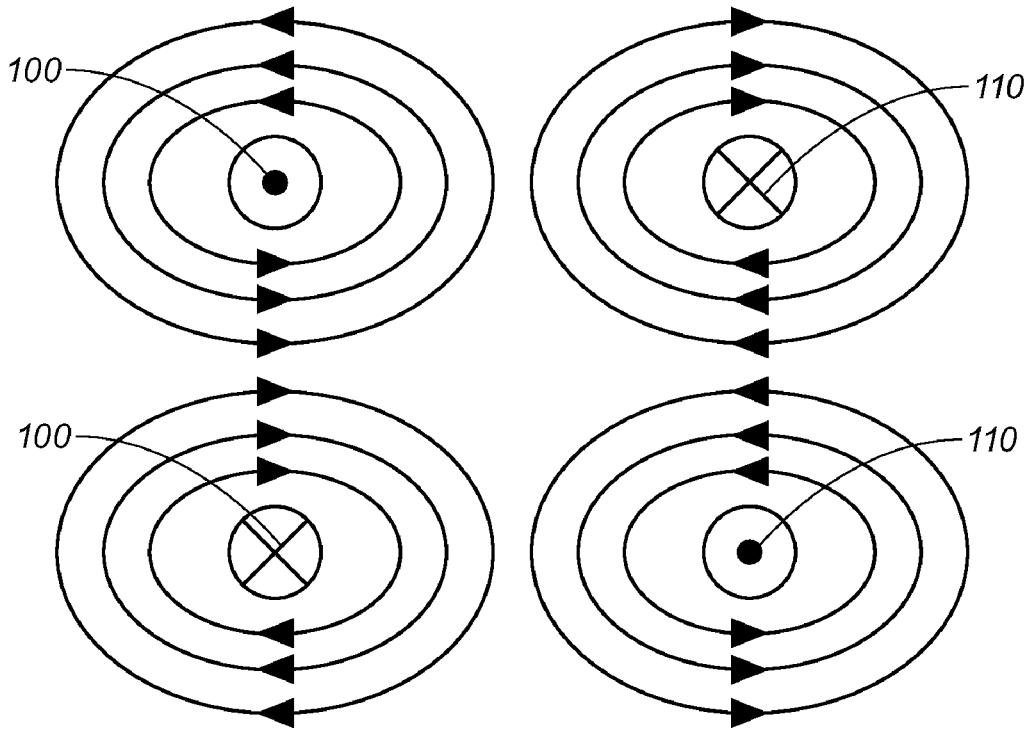
FIG. 3 shows a schematic view of an illustration presenting a magnetic distortion field generated according to the present invention.

A main magnetic flow 140 is induced in the magnetic core 20 by the main current circulating in the primary winding (not shown). When a variation in the reactive power occurs in the node where the reactor and/or a variation in the profile of the electric tension of said node occur, then the means to provide control current (not shown) provide simultaneously an alternate or continual control current to each of the generators of magnetic distortion fields 90, supplying simultaneously control current to the first control coil 120 and to the second control coil 130. Thus, the first control coil 120 generates a first magnetic control flow 150 in the magnetic core 20, while the second control coil 130 generates a second magnetic control flow 160 in the opposite direction of the first magnetic control flow 150. Both magnetic control flows 150 and 160 forming a magnetic distortion field 170 in the magnetic core 20 that combine with the main magnetic flow 140. The intensity of the control current supplied to the generators of magnetic distortion fields 90 correspond to the detection of the reactive power of consumption required in relation to the profile of the electric voltage node of the power system to which the reactor is connected. FIG. 3 shows a presentation of the magnetic distortion field 170 generated.

Each of the magnetic distortion fields 170, when combined with the main magnetic flow 140 act in an analogue or equivalent manner to the function of the physical air gap in the magnetic core 20, but with the difference that the size of the magnetic distortion field 170 varies according to the intensity of the control current supplied to the generator of the magnetic distortion field 90, specifically to the first control coil 120 and to the second control coil 130. Therefore, logically, it would be like having the function of an air gap of a variable size according to the operation requirements of the reactor of controlled reactive power 10.

It is important to mention that the generators of magnetic distortion fields 90 must be connected in series or parallel in order to generate the magnetic distortion fields 170 of the same intensity, and located in a position relative to the magnetic core 20 so that the magnetic equilibrium of the latter may be maintained to ensure balanced reactive powers of consumption.

The presence of a magnetic distortion field 170 in a magnetic circuit provokes changes in the reluctance of that field itself. At a bigger amount of and/or intensity of the magnetic distortion field 170, the change in reluctance increases. Therefore, in a controlled reactive power reactor 10, in the presence of a change in reluctance, the main current of the main winding will vary to maintain the main magnetic flow 140 constant. Based on the principle of magnetic stability of an electro-magnetic system, and with a variation in the supplied currents to the control windings, a variation in the magnetic distortion is encountered. Therefore, there is a variation in the core reluctance. This originates a variation in the main current to maintain the main magnetic flow constant. Experienced variation of the main current is translated into a variation of the consumed reactive power, which in this case is the variable of the required control for a controlled reactive power reactor according to the present invention.

The above described is expressed mathematically in the following:

If a magnetic distortion field 170 is present in the magnetic circuit of a reactor, then a variation in its reluctance is present according to the following equations:

$$\Delta R = \frac{\Delta Fmm}{\phi}$$

$$\Delta R = \frac{N(I_{p1} - I_{p0})}{BA}$$

Where:

ΔR is the variation of the reluctance.

ΔFmm is the variation of the magnetomotive force.

ϕ is the main magnetic flow.

N is the amount of turns of the primary winding.

$I_{p1}$ is the primary winding current after the reluctance variation.

$I_{p0}$ is the primary winding current before the reluctance variation.

B is la magnetic flow density.

A is the column area of the magnetic core.

Q reactive power consumed by the reactor.

As an example, because of the increase in reluctance, the primary winding current ($I_P$) will increase to maintain the main magnetic flow (ϕ) constant (cte).

$$\Uparrow I_P \leftrightarrow \phi = \text{cte}$$

Such increment in the primary winding current ($I_P$) is translated as an increment in the consumption of reactive power (Q); while a decrease in the primary winding current ($I_P$) is reflected as a decrease in the reactive power consumption (Q) of the reactor.

$$\Uparrow I_P \leftrightarrow \Uparrow Q \quad \Downarrow I_P \leftrightarrow \Downarrow Q$$

Figure 4:
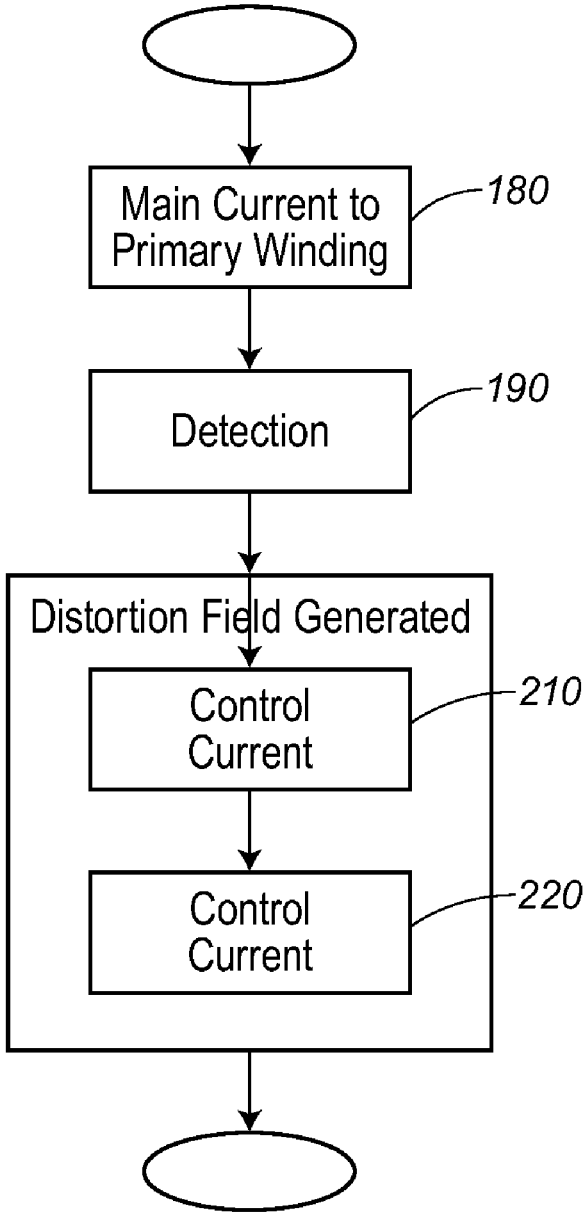
FIG. 4 shows a block diagram of a method to adjust the reactive power of an electric reactor according to the present invention.

Turning now to FIG. 4, in conjunction with FIG. 2, a block diagram is shown of a method to adjust the reactive voltage of an electric reactor according to the present invention. The method starts in step 180 when a main current is supplied to a primary winding (not shown) to induce a main magnetic flow 140 in the magnetic core 20.

Next, in step 190, the required reactive power of consumption in relation to the requirements of reactive voltage compensation is detected, which demands the voltage system to which the controlled reactive electric voltage reactor 10 is connected, to proceed in step 200 and generate at least one magnetic distortion field 170 in the magnetic core 20 (where in case of a three-phase reactor the magnetic equilibrium is controlled to ensure the balanced reactive consumption voltages). Thus, each magnetic distortion field 170 combines with the main magnetic flow 140, generating a distortion in the latter. In this way the reactive consumption power of said reactor is accomplished, because as the current varies in the main winding, also the reactive voltage will vary, which is the desired control variable.

The magnetic distortion field 170 can be generated when supplying, in step 210, a control current, whether alternate or continual at an intensity that varies in relation to the detection of the reactive power of consumption required in relation to the profile of the electric node voltage of the power system to which the reactor is connected, to a first control coil 120 to generate a first magnetic control flow 150 over the magnetic core 20, where the first control coil 120 is wound in a first pair of orifices 100 in the magnetic core 20. Simultaneously, in step 220, said control current is supplied to a second control coil 130 to generate a second magnetic control flow 160 in the magnetic core 20, where the second control coil 130 is wound in a second pair of orifices 110 in the magnetic core 20 so that the second magnetic control flow 160 has an opposite direction to the first magnetic control flow 150, thus forming the magnetic distortion field 170 whose representation of magnetic field lines is shown in FIG. 3.

An alternative embodiment of this invention, and with the purpose of maintaining the required safety redundancy in the reactor, consists in combining the use of generators of magnetic distortion and the structure of a central column of air gaps. So, in case of failure of the magnetic distortion generators, the central column of air gaps accomplishes its committed safety redundancy. In this case, the electric reactor of controlled reactive power may be formed in a very similar way to the reactor described in FIG. 1, but with the difference that the central column is replaceable by a central column of air gaps that in turn consists of a number of ferro-magnetic doughnuts and air-gap spacers embedded between the ferro-magnetic doughnuts, and as a whole are stacked in the form of a central column. The central column of air gaps is maintained extremely rigid by the union of the ferro-magnetic doughnuts and the air-gap spacers via the use of epoxy glue and of a central bolt that passes completely through the column and maintains it to the upper and inferior yoke through the us of a bolt-nut mechanism, thus allowing to eliminate the vibrations during the operation of the reactor.

In addition to the above, the magnetic core consists of at least one field generator of magnetic distortion that may be formed by a first pair of orifices and a second pair of orifices that pass through the thickness of the magnetic core, whether through an external column or a yoke of the mentioned structure of a window type. In another embodiment of the invention, the magnetic distortion generator may be located in one or more ferro-magnetic doughnuts of the central column of air gaps.

As to the method to adjust the reactive power of an electric reactor described with the use of the safety redundancy according to the former paragraphs, it is similar to the method described in FIG. 4.

Figure 5:
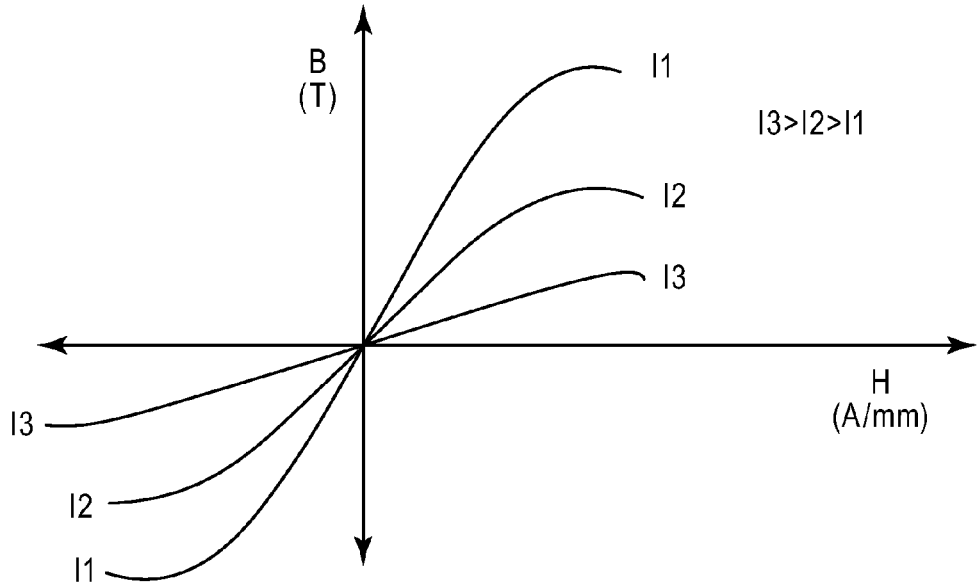
FIG. 5 shows a diagram with different magnetizing curves of an electric reactor according to the present invention.

FIG. 5 shows different magnetizing curves of an electric reactor with at least one primary winding and a group of "n" generators of magnetic distortion field in its magnetic core, these curves are obtained starting from a value of fixed excitation current in the primary winding and with different values of current I1, I2 and I3 in the generators of the magnetic distortion field. In this way, it can be observed that as the value of the current in the generators of the magnetic distortion field increases, the density of the magnetic flow B reduces to a certain value of excitation in the primary winding. This is equivalent to having a magnetic core with reduced magnetic permeability or the presence of real air spaces in the magnetic core. In other words, it can be observed that, as if a reactor of a variable magnetic permeability were obtained, a parameter that is also controlled through the present invention. It is observed that the value of the initial magnetic permeability is the same in all cases. As the value of the current in the generators of the magnetic distortion field increases, the effect of the magnetic permeability increases.

Control over the magnetizing curves allows control of the saturation level, and as a consequence the harmonics in the current and electric voltage signals. This is, as the saturation level increases, the contents of the harmonics increases, and vice versa.

Although the invention has been described with reference to specific embodiments, this description in not meant to be constructed in a limited sense. The various modifications of the disclosed embodiments, as well as alternative embodiments of the invention, will become apparent to person skilled in the art upon reference to the description of the invention. It is, therefore, contemplated that the appended claims will cover such modifications that fall within the scope of the invention, or their equivalents.

We claim:

1. A electric reactor of controlled reactive power comprising:

a magnetic core having a central column positioned in spaced parallel relation to a pair of external columns positioned on opposite sides of said central column, said magnetic core having a superior yoke connected to one end of said central column and to an end of said pair of external columns, said magnetic core having an inferior yoke connected to an opposite end of said central column and to an opposite end of said pair of external columns, said superior yoke having a first pair of orifices positioned between said central column and one of said pair of external columns, said superior yoke having a second pair of orifices positioned between said central column and another of said pair of external columns;

a primary winding concentrically wound around said central column;

a first control coil wound through said first pair of orifices;

a second control coil wound through said second pair of orifices;

a main current supplying means connected to said primary winding for supplying a main magnetic flow in said magnetic core;

a control current supplying means connected to said first and second control coils for generating a first magnetic control flow in said magnetic core and for generating a second magnetic control flow in said magnetic core such that said second magnetic control flow has a direction opposite to a direction of said first magnetic control flow and such that said first and second magnetic control flows form a magnetic distortion field, said magnetic distortion field combining with said main magnetic flow so as to cause a change in reluctance of said magnetic core.

2. The electric reactor of claim 1, said first control coil being spirally wound.

3. The electric reactor of claim 1, said second control coil being spirally wound.

4. The electric reactor of claim 1, said main current supplying means for passing an alternating current.

5. The electric reactor of claim 1, said control current supplying means for passing an alternating current.

* * * * *